US006855097B2

(12) United States Patent
Krull

(10) Patent No.: US 6,855,097 B2
(45) Date of Patent: Feb. 15, 2005

(54) ADJUSTABLE MASS EXERCISE METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 469 days.

(21) Appl. No.: 10/127,050

(22) Filed: Apr. 18, 2002

(65) Prior Publication Data

US 2003/0199369 A1 Oct. 23, 2003

(51) Int. Cl.[7] ..... A63B 27/072
(52) U.S. Cl. ..... 482/107; 482/108
(58) Field of Search ..... 482/93, 94, 98, 482/106–109, 104

(56) References Cited

U.S. PATENT DOCUMENTS 1,779,594 A * 10/1930 Collins ..... 482/107
4,529,198 A * 7/1985 Hettick, Jr. ..... 482/104
5,344,375 A * 9/1994 Cooper ..... 482/106
6,033,350 A * 3/2000 Krull ..... 482/98
6,083,144 A * 7/2000 Towley et al. ..... 482/107
6,099,442 A * 8/2000 Krull ..... 482/107
6,149,558 A * 11/2000 Chen ..... 482/107
6,186,928 B1 * 2/2001 Chen ..... 482/107
6,196,952 B1 * 3/2001 Chen ..... 482/107
6,228,003 B1 * 5/2001 Hald et al. ..... 482/107
6,261,022 B1 * 7/2001 Dalebout et al. ..... 482/107
6,500,101 B1 * 12/2002 Chen ..... 482/107
2003/0148862 A1 * 8/2003 Chen et al. ..... 482/108

* cited by examiner

*Primary Examiner*—Justine R. Yu
*Assistant Examiner*—Victor K. Hwang

(57) ABSTRACT

An exercise dumbbell includes a handle and weight plates maintained in spaced relationship relative thereto. At least one weight selector is movable into and out of engagement with different combinations of the weight plates to secure a desired amount of mass to the handle.

27 Claims, 7 Drawing Sheets

Fig. 3
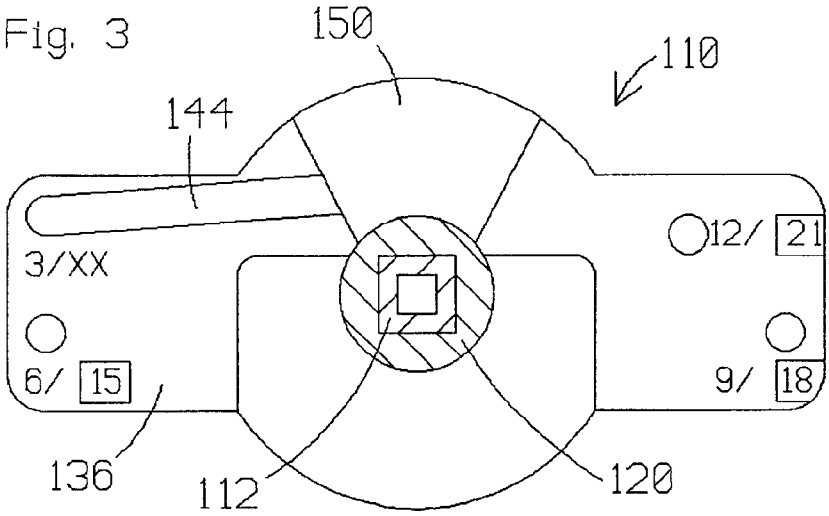
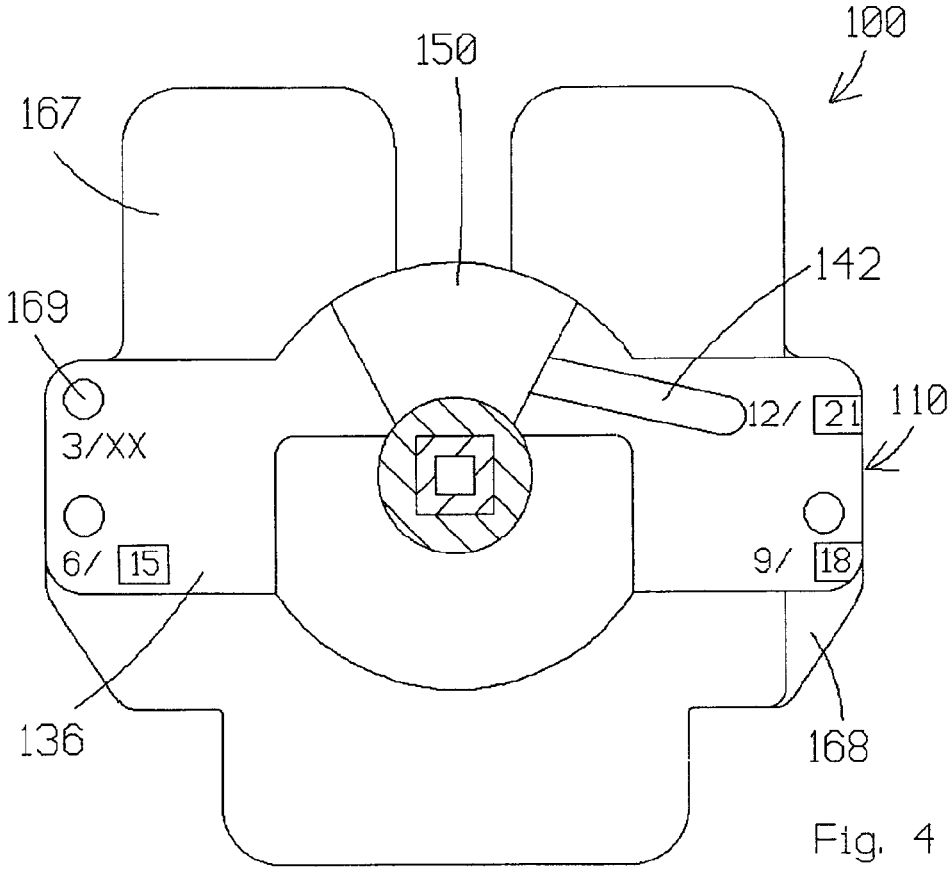
Fig. 4

Fig. 19
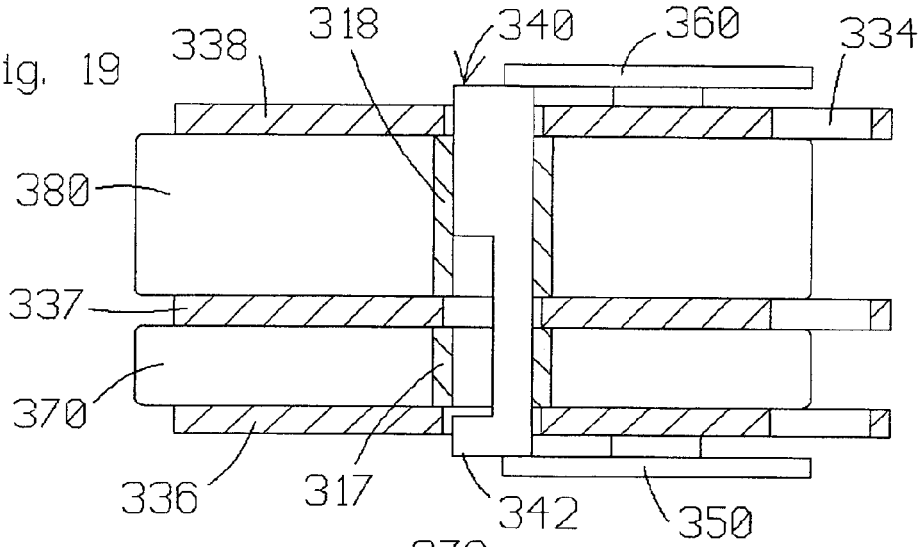
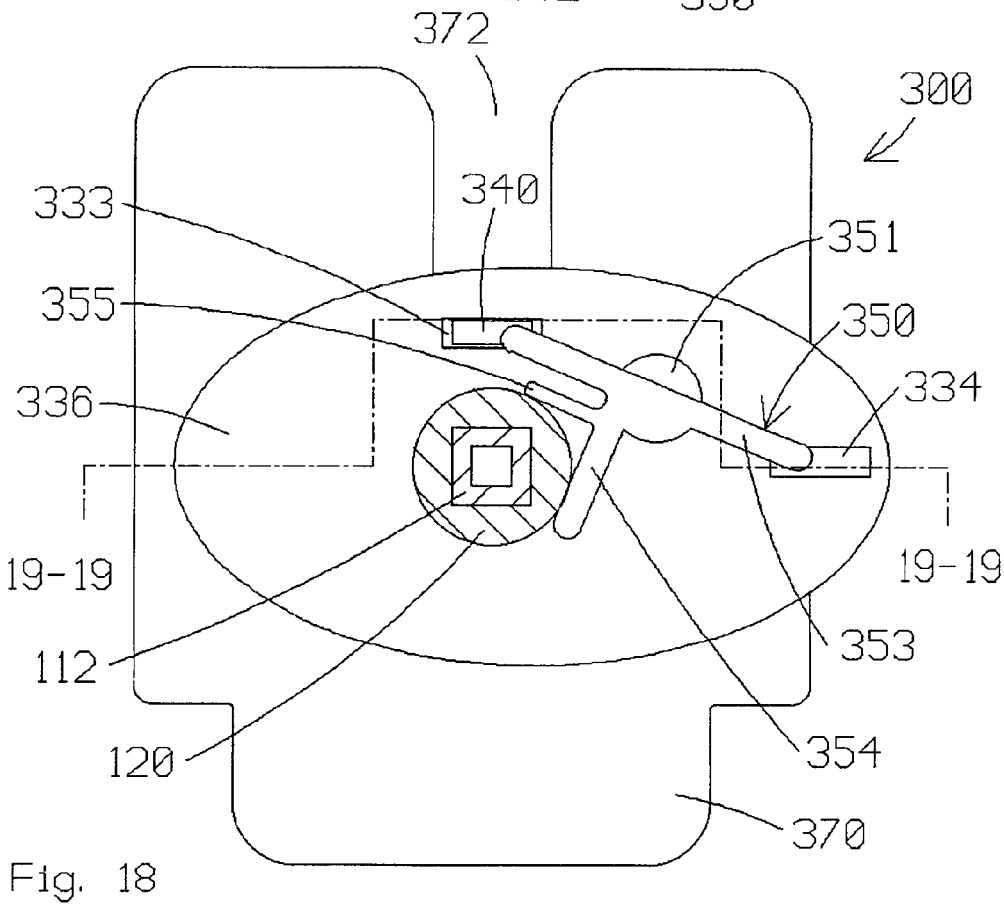
Fig. 18

ADJUSTABLE MASS EXERCISE METHODS AND APPARATUS

FIELD OF THE INVENTION

The present invention relates to exercise equipment and more particularly, to methods and apparatus for adjusting weight resistance to exercise activity.

BACKGROUND OF THE INVENTION

An object of the present invention is to provide improved apparatus and/or methods for selecting different combinations of weight to resist exercise movement.

SUMMARY OF THE INVENTION

The present invention provides methods and apparatus involving the movement of mass subject to gravitational force. In a preferred application, the present invention allows a person to adjust weight resistance by securing a desired amount of mass to opposite ends of a weight lifting member.

In one respect, the present invention may be described in terms of a method of adjusting free weight resistance to exercise. In this regard, a weight lifting member is provided with weight supports and defines a longitudinal axis. Weights are provided and configured to be supported by the weight supports. A weight selector is provided with a first end portion sized and configured for insertion into less than all of the weights, and a relatively longer, second end portion sized and configured for insertion into a relatively greater number of the weights. The first end portion and the second end portion are alternatively inserted into respective weights to secure desired combinations of the weights to the weight lifting member. In a preferred application, the weight lifting member includes a handle, and the weight supports are disposed at opposite ends of the handle.

In another respect, the present invention may be described in terms of exercise dumbbells. One such dumbbell includes a handle that defines a longitudinal axis. Weight supports are secured to opposite ends of the handle. Weights are sized and configured to be supported by the weight supports. The weights include a first weight having an outwardly projecting tab that extends laterally in a first direction and defines a first hole, and a second weight having an outwardly projecting tab that extends laterally in an opposite, second direction and defines a second hole. When the first weight and the second weight are axially aligned, each said tab is visible from each end of the longitudinal axis. A weight selector is configured for insertion through at least one of the weight supports, through the first hole, and alongside of the second weight, and alternatively, for insertion through at least one of the weight supports, alongside of the first weight, and through the second hole.

Another such dumbbell similarly includes a handle that defines a longitudinal axis, weight supports mounted on opposite ends of the handle, and weights sized and configured to be supported by the weight supports. A weight selector has a first end portion configured to select a first combination of the weights upon insertion into a passage defined by at least some of the weight supports, and a second end portion configured to select a different, second combination of the weights upon insertion into the passage.

Yet another such dumbbell includes a handle that defines a longitudinal axis, weight supports mounted on opposite ends of the handle, and weights sized and configured to be supported in respective, axially spaced positions defined by the weight supports. A weight selector has a first end portion configured to span a first group of the weights upon insertion into a passage defined by at least some of the weight supports, and a relatively longer, second end portion configured to span a second group of the weights upon insertion into a passage defined by at least some of the weight supports.

Still another such exercise dumbbell includes a handle assembly having a handle that defines a longitudinal axis. First weight supports mounted on a first end of the handle assembly, and second weight supports mounted on a second end of the handle assembly. First end weights are configured to be supported in respective, axially spaced positions defined by the first weight supports. The first end weights include a first weight, a second weight that weighs twice as much as the first weight, and a third weight that weighs three times as much as the first weight. Second end weights are configured to be supported in respective, axially spaced positions defined by the second weight supports. The second end weights include a fourth weight, a fifth weight that weighs twice as much as the fourth weight, and a sixth weight that weighs three times as much as the fourth weight. At least one weight selector configured to releasably connect different combinations of the weights to the handle assembly.

Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 3 is a sectioned end view of the handle assembly of FIG. 1, taken along the section line 3—3 in FIG. 1;

FIG. 4 is a sectioned end view of the handle assembly and weight plates of FIG. 2, taken along the section line 4—4 in FIG. 2;

FIG. 18 is a sectioned end view of another exercise dumbbell constructed according to the principles of the present invention;

FIG. 19 is a partially sectioned top view of a portion of the exercise dumbbell of FIG. 18, taken along the section line 19—19;

DETAILED DESCRIPTION OF THE PREFERRED EMBODIMENT

Figure 2:
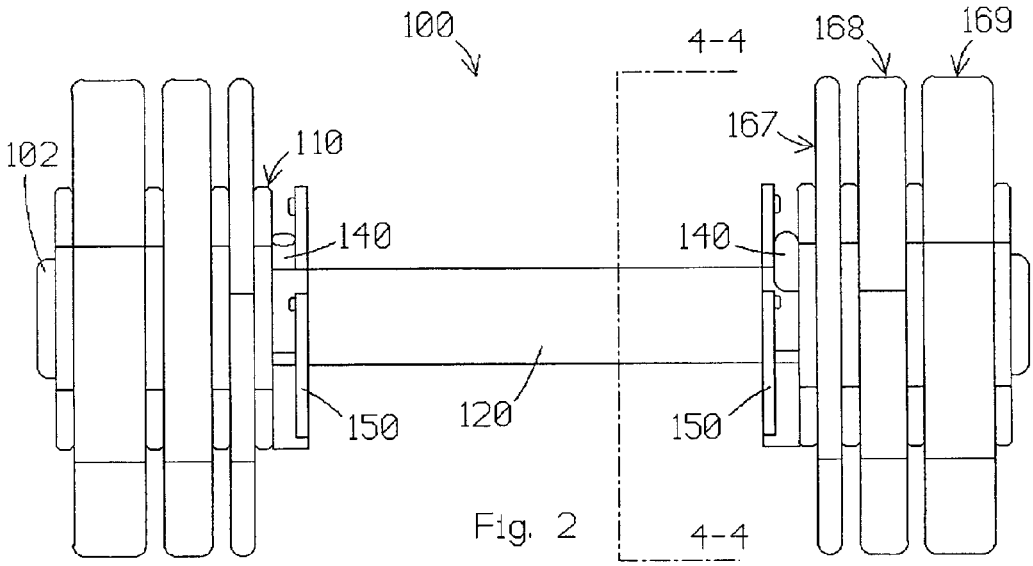
FIG. 2 is a side view of the handle assembly of FIG. 1 with weight plates secured to opposite ends thereof.
Figure 5:
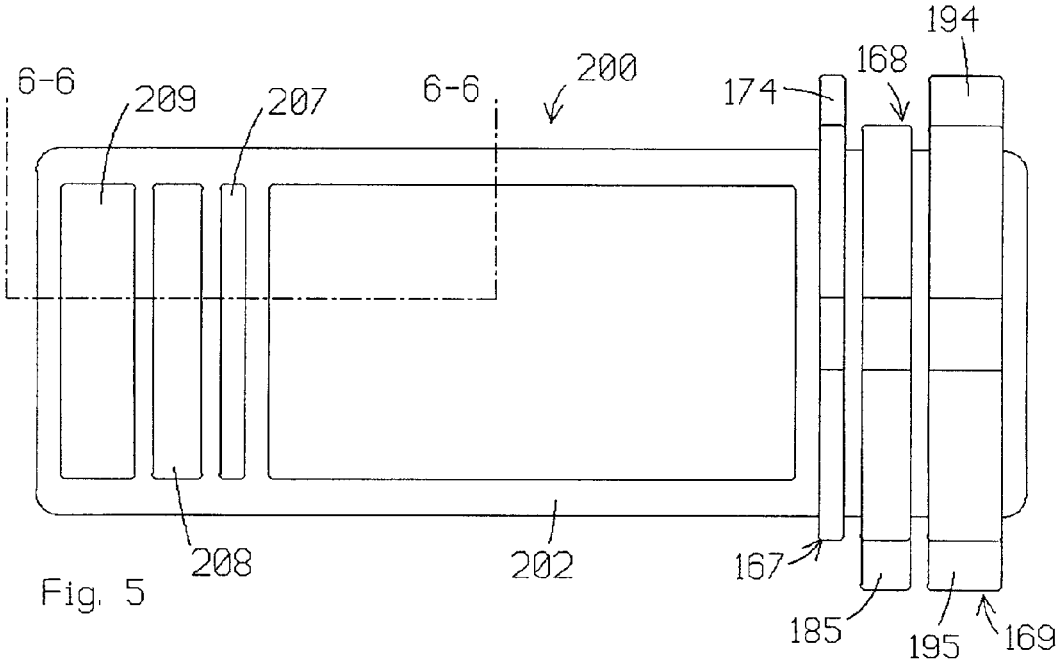
FIG. 5 is a top view of a base configured to support the weight plates of FIG. 2, and supporting a group of weight plates from one end of the handle assembly of FIG. 2.
Figure 6:
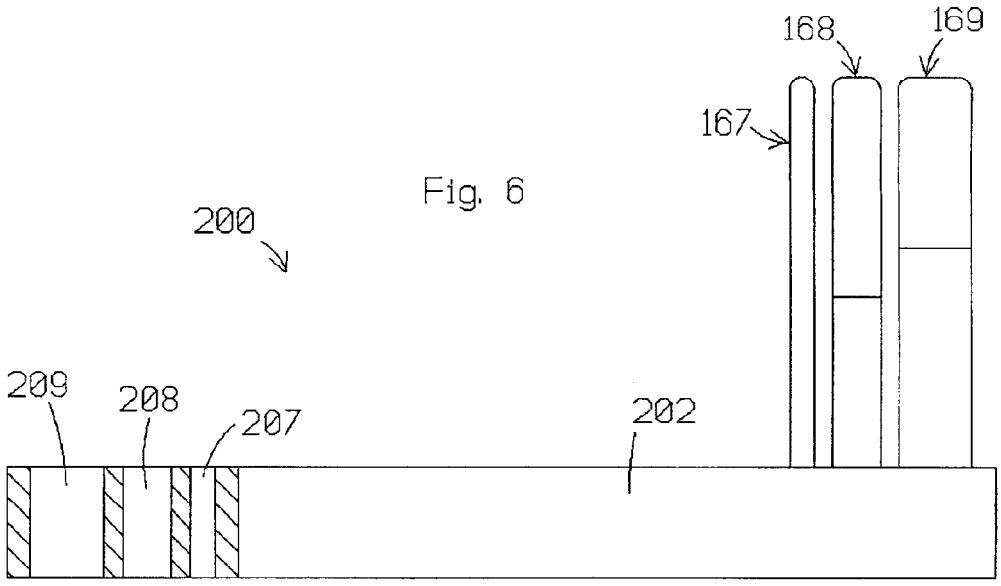
FIG. 6 is a partially sectioned side view of the base and weight plates of FIG. 5, taken along the section line 6—6.

An exercise dumbbell constructed according to the principles of the present invention is designated as 100 in FIGS. 2 and 4. The dumbbell 100 includes a weight lifting member or handle assembly 110, and a plurality of weight plates 167–169 that are selectively secured to the handle assembly 110. As shown in FIGS. 5–6, the weight plates 167–169 are supported by a base or cradle 200 when not in use. In other words, the base 200 is configured to support the weight plates 167–169 in a rest position.

The base 200 includes opposite end weight compartments that are interconnected by intermediate rails or walls 202. Each weight compartment defines three slots 207–209 that are configured to receive respective weight plates 167–169, and each weight compartment is bounded by opposite sidewalls that are configured to support respective shoulders on the weight plates 167–169. An advantage of this particular base 200 is that it may formed by extrusion (because it has a uniform profile as viewed from above or below). Another advantage of this particular base 200 is that it can be made narrower than the width of the weight plates 167–169. In any event, the dumbbell 100 may be used in conjunction with other bases in the alternative.

The handle assembly 110 includes a bar 112 that is preferably a square tube made of steel. The bar 112 extends substantially the entire length of the handle assembly 110. A hand grip 120 is mounted on an intermediate portion of the bar 112. The hand grip 120 is preferably a cylindrical tube made of plastic, and it may be knurled and/or contoured to facilitate a comfortable and reliable grip. As shown in FIGS. 3–4, the hand grip 120 fits snugly onto the bar 112 in a manner that prevents rotation relative thereto.

Figure 13:
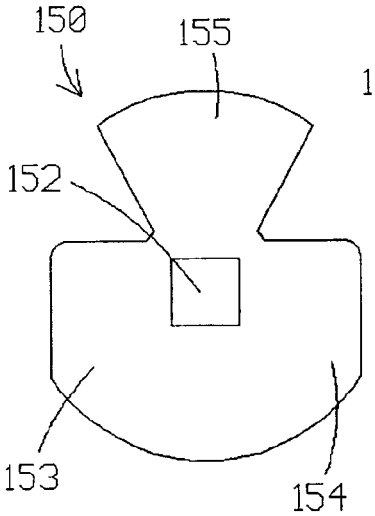
FIG. 13 is an end view of the retainer of FIG. 12.
Figure 12:
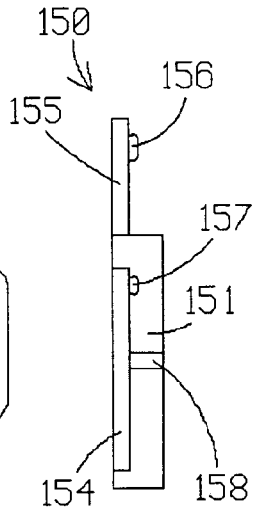
FIG. 12 is a side view of a retainer on the handle assembly of FIGS. 1 and 3.
Figure 14:
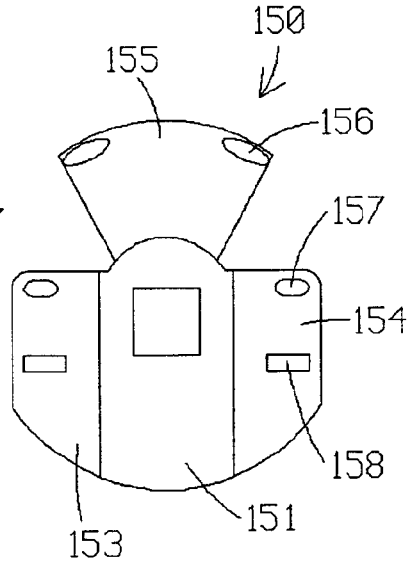
FIG. 14 is an opposite end view of the retainer of FIG. 12.

First and second retainers 150 are mounted on opposite ends of the bar 112 and bear against respective ends of the hand grip 120. One of the retainers 150 is shown by itself in FIGS. 12–14. The retainers 150 are preferably made of plastic and formed by injection molding. As on the hand grip 120, a square hole 152 extends through each retainer 150 to accommodate a snug fit on the bar 112 and prevent rotation relative thereto. The hole 152 extends through a relatively thick, central block portion 151 of the retainer 150. Three relatively thinner wings or flanges 153–155 extend outward from respective sides of the block portion 151. Tabs or nubs 156 are provided on the wing 155, and tabs or nubs 157 are provided on respective wings 153–154. Also, stops 158 are provided on respective wings 153–154.

First and second sets of support plates 136–139 and spacers 117–118 are mounted on respective ends of the bar 112 after the retainers 150. Like the retainers 150 and the hand grip 120, the support plates 136–139 and the spacers 117–118 fit snugly onto the bar 112 in a manner that prevents rotation relative thereto. The inner plates 136 cooperate with the wings 153–155 on respective retainers 150 to define respective gaps therebetween.

Figure 10:
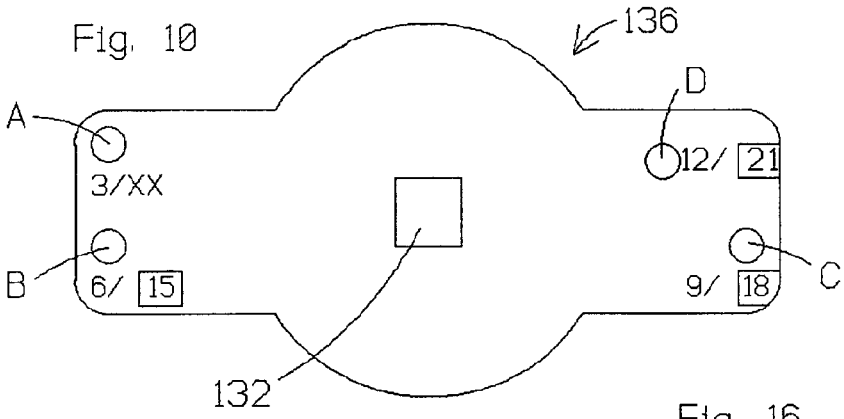
FIG. 10 is an end view of a support plate on the handle assembly of FIGS. 1 and 3.

One of the support plates 136 is shown by itself in FIG. 10. The plate 136 may be described in terms of a center portion that is circular, and opposite side portions that are generally rectangular. A square hole 132 extends through the center of the plate 136 to accommodate a snug fit on the bar 112 and prevent rotation relative thereto. Holes A–D extend through the plate 136, and the plate 136 bears indicia associated with the holes A–D.

Figure 11:
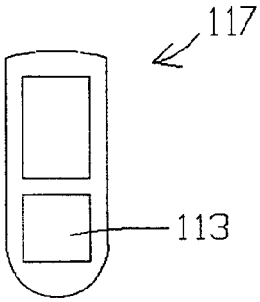
FIG. 11 is an end view of a spacer on the handle assembly of FIGS. 1 and 3.

One of the spacers 117 is shown by itself in FIG. 11. The spacer 117 may be described as a substantially hollow block that is configured to occupy a slot in one of the weight plates 167. A square hole 113 extends through the lower end of the spacer 117 to accommodate a snug fit on the bar 112 and prevent rotation relative thereto. An opening in the upper portion of the spacer 117 improves the strength-to-mass ratio of the part. The spacer 117 is one-half as long as the spacer 118.

Figure 1:
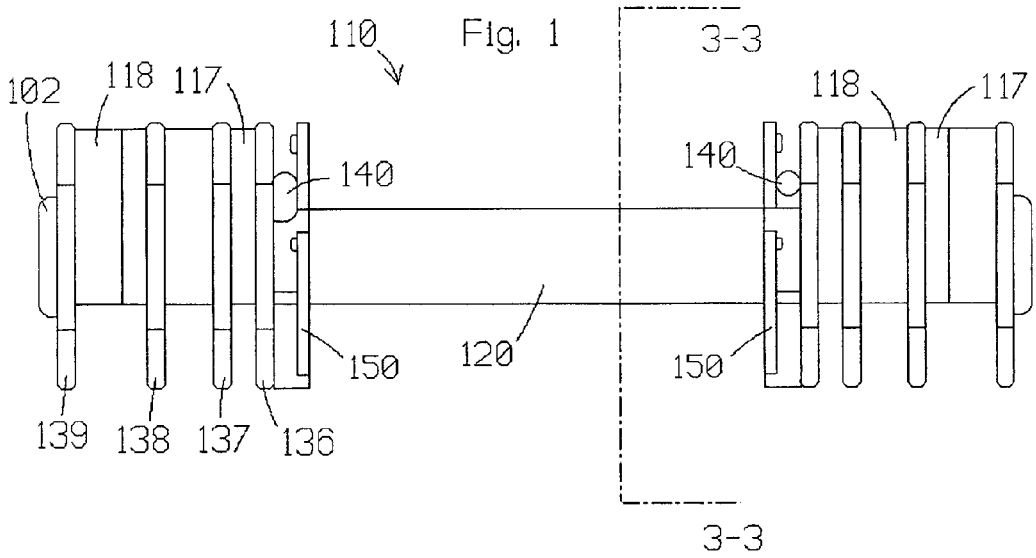
FIG. 1 is a side view of a handle assembly constructed according to the principles of the present invention.

Both the support plates 136–139 and the spacers 117–118 are preferably made of plastic and formed by injection molding. The plates 136–139 and the spacers 117–118 may be configured and arranged to limit the amount of tooling required to make the handle assembly 110. For example, as many as all of the plates 136–139 may be made identical to one another (as shown in FIG. 1, with one end of the handle assembly 110 a rotated copy of the other end), and/or the two spacers 117–118 may be used in combination to provide a third, relatively longer spacer (as shown in FIG. 1). Also, the plates 136–139 and the spacers 117–118 may be formed as separate parts or combined into one or more unitary pieces. For example, on an alternative embodiment, the innermost plate 136 and the adjacent spacer 117 may be formed as a unitary part, and the adjacent plate 137 and subsequent spacer 118 may be formed as a unitary part. A duplicate of the former part may be used at the same end of the handle assembly 110, and a duplicate of the latter part may be used at the opposite end of the handle assembly 110 (when the two ends are configured as mirror images of one another). This alternative embodiment may be considered advantageous to the extent that the parts are both fewer in number and enhanced in terms of structural integrity.

First and second fasteners 102 are secured to respective ends of the bar 112, preferably in a manner that clamps the other components therebetween. Each fastener 102 is preferably a self-tapping screw having a shaft that threads into a respective end of the bar 112, and a relatively larger diameter head that overlies a respective outer end support 139.

Figure 7:
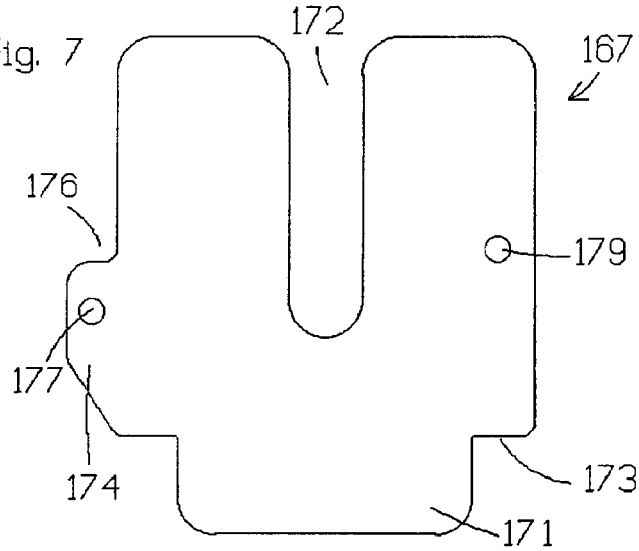
FIG. 7 is an end view of a first weight plate shown in FIGS. 2 and 5–6.

One of the weight plates 167 is shown by itself in FIG. 7. The weight plate is preferably made of steel and configured to weigh one and one-half pounds (or 0.75 kg on a metric embodiment). An upwardly opening slot 172 extends into the plate 167 and is configured to receive a spacer 117. The weight plate 167 has a relatively narrow lower end 171 that is configured for insertion into a slot 207 on the base 200. The transition between the lower end 171 and the upper portion of the plate 167 is defined by opposite side shoulders that project laterally outward and have downwardly facing edges 173. A tab 174 protrudes laterally outward from one side of the plate 167, thereby defining a notch or space 176 directly above the tab 174. A hole 177 extends through the tab 174, and a hole 179 extends through the plate 167 proximate the side opposite the tab 174.

Figure 8:
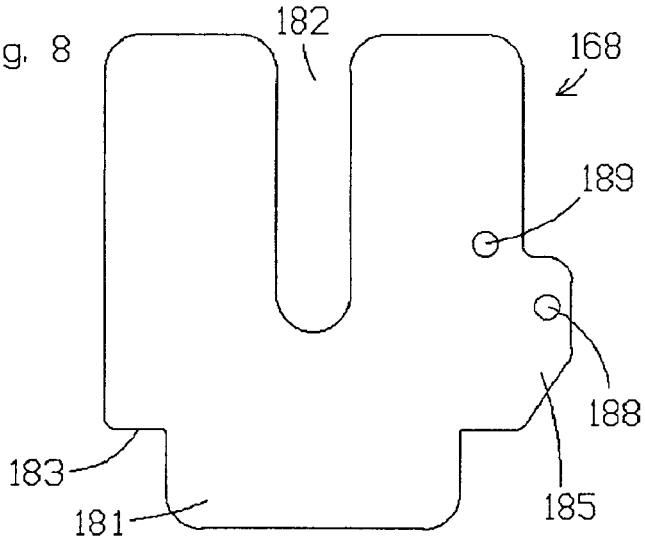
FIG. 8 is an end view of a second weight plate shown in FIGS. 2 and 5–6.

One of the weight plates 168 is shown by itself in FIG. 8. The weight plate is preferably made of steel and configured to weigh three pounds (or 1.5 kg on a metric embodiment). An upwardly opening slot 182 extends into the plate 168 and is configured to receive a spacer 118. The weight plate 168 has a relatively narrow lower end 181 that is configured for insertion into a slot 208 on the base 200. The transition between the lower end 181 and the upper portion of the plate 168 is defined by opposite side shoulders that project laterally outward and have downwardly facing edges 183. A tab 185 protrudes laterally outward from one side of the plate 168, and a hole 188 extends through the tab 185. A hole 189 extends through the plate 168 proximate the tab 185, and the hole 189 aligns with the hole 179 in the plate 167 when the slots 182 and 172 are aligned and the tabs 185 and 174 are arranged to extend in opposite directions. In other words, the holes 189 and 179 align when the plates 168 and 167 are aligned with neither tab 185 or 174 overlapping the other plate.

Figure 9:
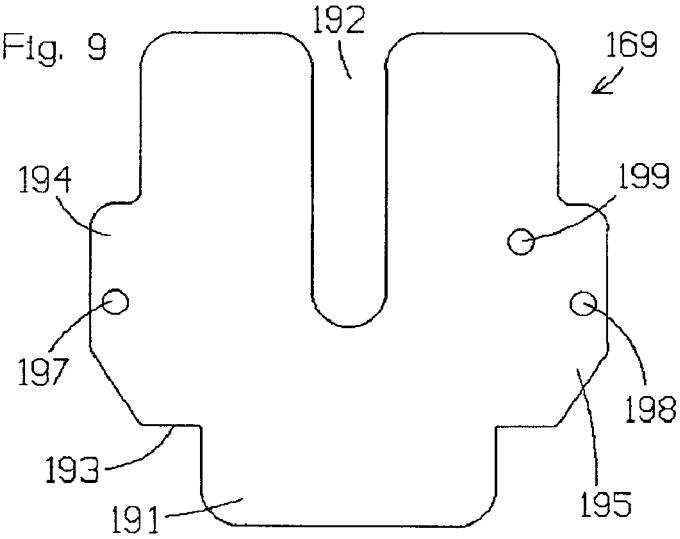
FIG. 9 is an end view of a third weight plate shown in FIGS. 2 and 5–6.

One of the weight plates 169 is shown by itself in FIG. 9. The weight plate is preferably made of steel and configured to weigh four and one-half pounds (or 2.25 kg on a metric embodiment). An upwardly opening slot 192 extends into the plate 169 and is configured to receive a respective spacer (shown as a combination of one spacer 117 and one spacer 118). The weight plate 169 has a relatively narrow lower end 191 that is configured for insertion into a slot 209 on the base 200. The transition between the lower end 191 and the upper portion of the plate 169 is defined by opposite side shoulders that project laterally outward and have downwardly facing edges 193. Tabs 194 and 195 protrude laterally outward from opposite sides of the plate 169 and overlap respective tabs 174 and 185 on the plates 167 and 168. A hole 197 extends through the tab 194 and aligns with the hole 177 through the tab 174 when the two tabs 194 and 174 are aligned with one another. A hole 198 extends through the tab 195 and aligns with the hole 188 through the tab 185 when the two tabs 195 and 185 are aligned with one another. A hole 199 extends through the plate 169 proximate the tab 195, and the hole 199 aligns with the holes 179 and 189 when the tabs 195 and 185 are aligned with one another.

Among other things, FIG. 4 shows an end view of the weight plates 167–169 in axial alignment with one another and oriented as shown in FIGS. 7–9. The plate 167 is nearest the reader; the tab 185 on the plate 168 is partially visible; and a portion of the plate 169 is visible through the hole A in the supports 136–138 (and through the space 176 above the tab 174 ).

Figure 16:
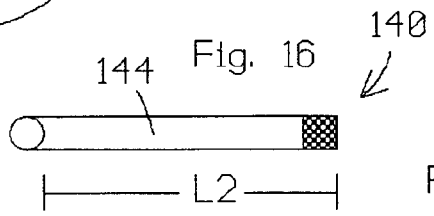
FIG. 16 is a top view of the weight selector of FIG. 15.
Figure 15:
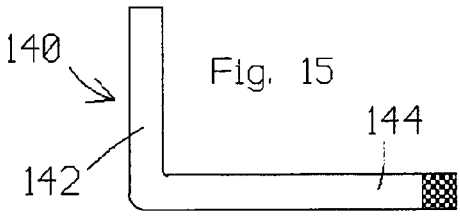
FIG. 15 is a side view of a weight selector on the handle assembly of FIGS. 1 and 3.
Figure 17:
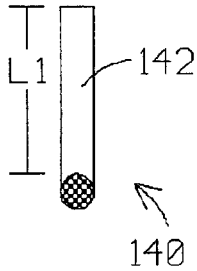
FIG. 17 is an end view of the weight selector of FIG. 15.

FIGS. 15–17 show a weight selector 140 by itself. The weight selector 140 is preferably an L-shaped pin that is made of steel. The weight selector 140 includes a first end portion 142 having a length L1, and a second end portion 144 having a relatively greater length L2. The length L1 is preferably sufficient to accommodate insertion of the first end portion 142 through respective plates 136–137 and respective weight plates 167–168, and into but not entirely through a respective plate 138. The length L2 is preferably sufficient to accommodate insertion of the second end portion 144 through all of the plates 136–139 and weight plates 167–169 at one end of the handle assembly 110. The subject invention will function with somewhat shorter lengths L1 and L2, as well.

FIG. 3 shows the shorter end portion of the weight selector 140 inserted into the holes A in at least the spacers 136–137, and perhaps the spacer 138. The opposite end portion 144 is rotated to a latched position behind the wing 155 on the retainer 150, and between the central block 151 and a respective tab 156. The wing 155 is preferably configured to deflect (like a leaf spring) to accommodate movement of either end portion 142 or 144 past either tab 156. In other words, the end portion 144 "snaps" into and out of the position shown in FIG. 3. The end portion 144 must be rotated clear of the wing 155 before the end portion 142 can be removed from the handle assembly 110.

FIG. 4 shows the longer end portion of the weight selector 140 inserted into the holes D in at least the spacers 136–138, and perhaps the spacer 139. The opposite end portion 142 is rotated to a latched position behind the wing 155 on the retainer 150, and between the central block 151 and a respective tab 156. The end portion 142 must be rotated clear of the wing 155 before the end portion 144 can be removed from the handle assembly 110.

The wing portions 153–154 are provided to engage the shorter end portion 142 of the weight selector 140 when the longer end portion 144 is inserted through either of holes B or C (because the end portion 142 falls short of the wing portion 155 in such cases). The wing portions 153–154 are also preferably configured to deflect (like a leaf spring) to accommodate movement of the end portion 142 past a respective tab 157. The stops 158 are provided on the wing portions 153–154 to limit downward pivoting of the end portion 142 (because it falls short of the central block 151 in such cases).

The indicia on the plate 136 indicate how much the handle assembly 110 will weigh when each weight selector 140 is similarly inserted into any of the holes A–D at each end of the handle assembly 110. The first numbers indicate the mass associated with insertion of the shorter end portion 142 of the weight selector 140, and the second, "boxed" numbers indicate the mass associated with insertion of the longer end portion 144. The "XX" indicates that the longer end portion 144 may not be inserted into the hole A. At least part of one of the end portions 142 and 144 is marked to help the user distinguish between the two end portions and/or to associate each end with a respective set of indicia. For example, on the depicted embodiment, the shaded tip goes with the "boxed" numbers.

When each weight selector 140 occupies the position shown in FIG. 3, the end portions 142 by-pass the weight plates 167–168 and fall short of the weight plates 169, and the indicia correctly indicates that the empty handle assembly 110 will weigh three pounds (or 1.5 kg on a metric embodiment) when lifted from the base 200. When each weight selector 140 occupies the position shown in FIG. 4, the end portions 144 engage all of the weight plates 167–169, and the indicia correctly indicates that the fully loaded handle assembly 110 will weigh twenty-one pounds (or 10.5 kg on a metric embodiment) when lifted from the base 200. The following chart shows the different amounts of balanced weight that are available on the dumbbell 100.

| Hole-End | Handle | Weights 167 | Weights 168 | Weights 169 | Total |
|---|---|---|---|---|---|
| A-142 | 3 | 0 | 0 | 0 | 3 |
| B-142 | 3 | 3 | 0 | 0 | 6 |
| C-142 | 3 | 0 | 6 | 0 | 9 |
| D-142 | 3 | 3 | 6 | 0 | 12 |
| B-144 | 3 | 3 | 0 | 9 | 15 |

-continued

| Hole-End | Handle | Weights 167 | Weights 168 | Weights 169 | Total |
|---|---|---|---|---|---|
| C-144 | 3 | 0 | 6 | 9 | 18 |
| D-144 | 3 | 3 | 6 | 9 | 21 |

An advantage of the dumbbell 100 is that only three discrete weight plates are required on each side of the dumbbell to provide seven different, balanced dumbbell loads. Another advantage of the dumbbell 100 is that six additional, somewhat out of balance loads may be selected, as well. For example, the handle assembly 110 may be set to weigh seven and one-half pounds by selecting only the weight plate 167 at one end of the handle assembly 110, and only the weight plate 168 at the other end of the handle assembly 110.

As already discussed above to some extent, various changes may be made to the dumbbell 100 to arrive at alternative embodiments of the subject invention. For example, retainers 150 (or variations thereof) may be mounted on the distal ends of the handle assembly 110, as opposed to opposite ends of the hand grip 120, in which case the sequence of the weight plates 167–169 is preferably reversed, as well. Also, the weight plates may be arranged in a different order, and/or provided in different numbers, weight amounts, and/or combinations. For example, weight plates weighing one pound, two pounds, and three pounds may be substituted for the weight plates 167–169. The resulting dumbbell may be adjusted between three and fifteen pounds in one pound increments. On another embodiment, a handle assembly weighing five pounds may be combined with weight plates weighing one and one-quarter pounds, two and one-half pounds, and three and three-quarters pounds to provide five to twenty pounds in increments of one and one-quarter pounds.

Another possible change is to provide weight selectors in the form of U-shaped pins. The opposite ends of the U-shaped pin may be similarly configured with lengths L1 and L2, and the "inactive" end may be inserted into a "storage" opening in the upper portions of the spacers 117 and 118 (and through modified support plates). On this alternative embodiment, the weight selector holes in the modified support plates are preferably disposed at a common radius from a centrally located storage opening. Also, a different retainer arrangement is required because the U-shaped pin cannot be rotated subsequent to insertion. One possible arrangement is described below with reference to yet another embodiment.

FIG. 18 shows an end of another dumbbell 300 constructed according to the principles of the present invention. Like the dumbbell 100, the dumbbell 300 includes a weight lifting member or handle assembly having a hand grip 120 mounted on an intermediate portion of a bar 112. A group of weight supports 336–338 and spacers 317–318 is mounted on each end of the bar 112. The spacers 317 and 318 are generally similar to the spacers 117 and 118.

Weight plates 370 and 380 are configured to receive respective spacers 317 and 318 and to fit between respective plates 336–339 in a manner similar to the weight plates 167–169 associated with the dumbbell 100. Each weight plate 370 is preferably made of steel and configured to weigh two and one-half pounds (or 1.25 kg on a metric embodiment), and each weight plate 380 is preferably made of steel and configured to weigh five pounds (or 2.5 kg on a metric embodiment). Upwardly opening slots 372 and 382 extend into respective weight plates 370 and 380 to accommodate respective spacers 317 and 318. Also, a notch extends laterally into each of the weight plates 370 and 380.

The supports 336–338 have an elliptical profile and define two slots 333 and 334. At least some of the supports 336–338 are preferably made of steel to make the empty handle assembly weigh five pounds (or 2.5 kg on a metric embodiment). The slots 334 align axially with the notches in the weight plates 370 and 380 when the spacers 317 and 318 occupy the slots 372 and 382 in respective weight plates 370 and 380.

On each end of the dumbbell 300, a weight selector 340 is alternatively inserted into one of the slots 333 and 334. Each weight selector 340 is preferably a generally rectangular strip of steel. Each weight selector 340 has a first end portion 342 and a second end portion 344. A notch 347 extends into one side of the bar 340 proximate the first end portion 342. The notch 347 is configured to accommodate passage of either weight plate 370 or 380 when radially aligned therewith.

FIG. 19 shows the weight selector 340 inserted through the slots 333, and through the slots 372 and 382 in the weight plates 370 and 380, respectively. In this situation, neither of the weight plates 370 or 380 is engaged by the weight selector 340 (regardless of the way in which the weight selector 340 is inserted into the slot 333). With both weight selectors 340 inserted in this manner, the handle assembly will weigh five pounds (or 2.5 kg on a metric embodiment) when lifted from an associated base.

Figure 20:
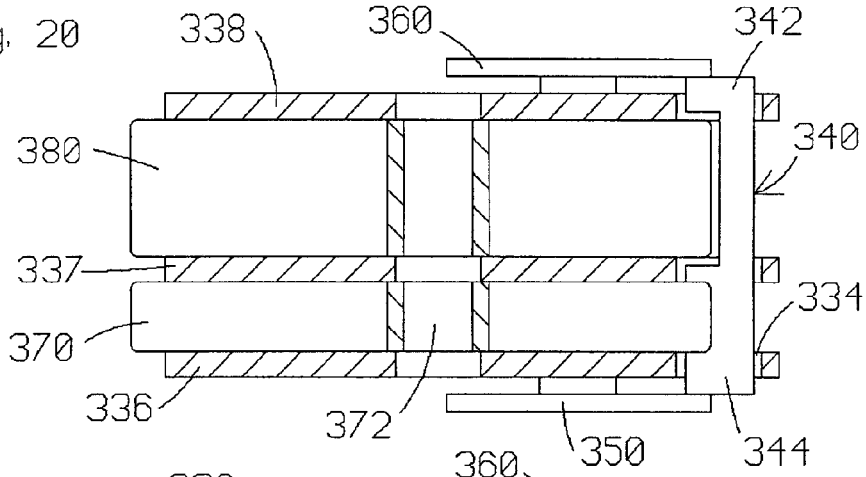
FIG. 20 is another partially sectioned top view of the portion of the exercise dumbbell of FIG. 19, showing a second weight selector arrangement.

FIG. 20 shows the weight selector 340 inserted through the slots 334 with the first end portion 342 leading the way, and with the notch 347 opening toward the weight plate 380. In this situation, the weight selector 340 occupies the notch in the weight plate 370 and thereby keys the weight plate 370 to the supports 336–338. With both weight selectors 340 inserted in this manner, the handle assembly will weigh ten pounds (or 5 kg on a metric embodiment) when lifted from an associated base.

Figure 21:
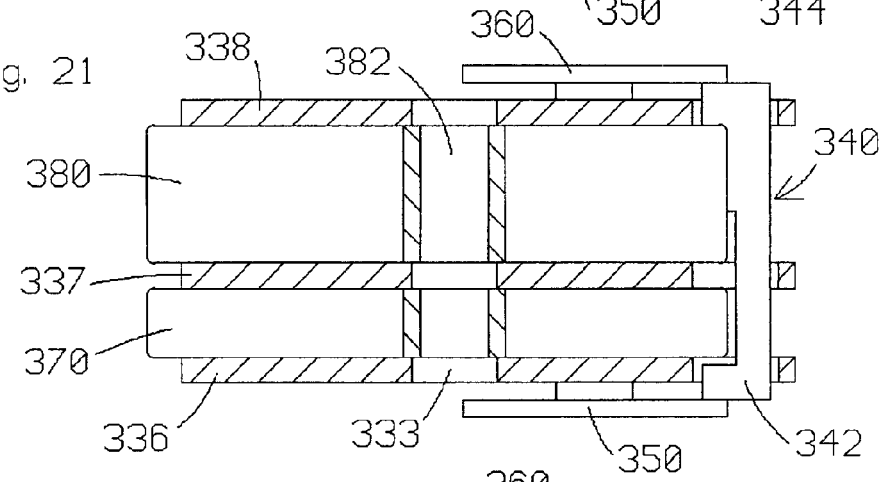
FIG. 21 is yet another partially sectioned top view of the portion of the exercise dumbbell of FIG. 19, showing a third weight selector arrangement.

FIG. 21 shows the weight selector 340 inserted through the slots 334 with the second end portion 344 leading the way, and with the notch 347 opening toward the weight plate 370. In this situation, the weight selector 340 occupies the notch in the weight plate 380 and thereby keys the weight plate 380 to the supports 336–338. With both weight selectors 340 inserted in this manner, the handle assembly will weigh fifteen pounds (or 7.5 kg on a metric embodiment) when lifted from an associated base.

Figure 22:
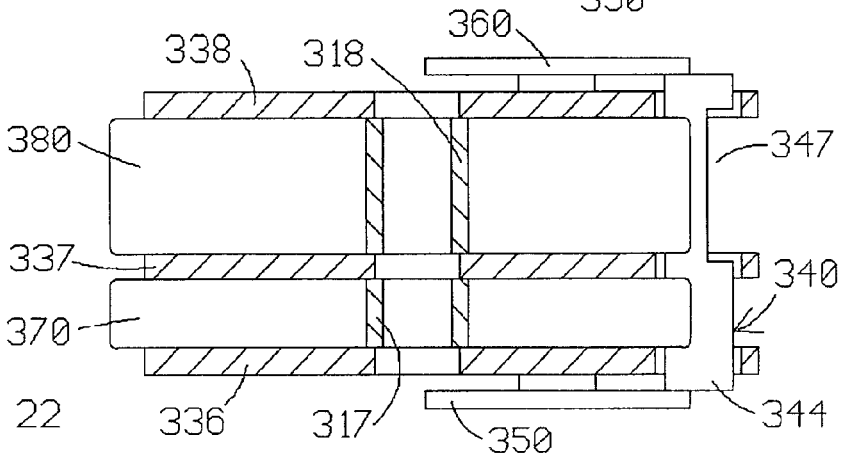
FIG. 22 is still another partially sectioned top view of the portion of the exercise dumbbell of FIG. 19, showing a fourth weight selector arrangement.

FIG. 22 shows the weight selector 340 inserted through the slots 334 with the first end portion 342 leading the way, and with the notch 347 opening away from the weight plates 370 and 380. In this situation, the weight selector 340 occupies the notches in both weight plates 370 and 380 and thereby keys both weight plates 370 and 380 to the supports 336–338. With both weight selectors 340 inserted in this manner, the handle assembly will weigh twenty pounds (or 10 kg on a metric embodiment) when lifted from an associated base.

As suggested by the foregoing description, the dumbbell 300 provides four different, balanced amounts of weight. Also, as on the dumbbell 100, additional, intermediate weight amounts may be selected by making a different weight selection at each end of the handle assembly. In other words, the dumbbell 300, is adjustable between five and twenty pounds in increments of two and one-half pounds (or between 2.5 kg and 10 kg in increments of 1.25 kg).

Latches 350 are mounted on respective inner end supports 336, and stops 360 are mounted on respective outer end supports 338. For purposes of manufacturing efficiency and/or alternative operating locations for the user, the stops 360 are preferably identical to the latches 350, and both will be described as retainers for ease of reference. The retainers 350 and 360 are preferably made of plastic and formed by injection molding.

As shown in FIG. 18, the retainer 350 includes a base or hub 351 that is rotatably mounted on the plate 336. Legs 353 extend in opposite directions from the hub 351 and overlie respective slots 333 and 334. An arm 354 extends away from the hub 351 in a direction perpendicular to the legs 353, and a finger 355 extends perpendicularly away from the arm 354 proximate the hub 351. The arm 354 and the finger 355 bear against respective portions of the hand grip 120 to discourage rotation of the retainer 350 relative to the plate 336. On the outboard retainer 360, the arm and finger bear against an end fastener (not shown) that may have a somewhat thicker head than the fasteners 102 on the dumbbell 100. In any event, the finger 355 is configured to deflect (like a leaf spring) to accommodate counter-clockwise rotation of the retainer 350 in response to application of sufficient torque by a user. In other words, the finger 355 biases the retainer to remain in the orientation shown in FIG. 18, thereby discouraging unintentional removal of the weight selector 340.

The present invention may also be described in terms of various methods of adjusting resistance to exercise, with reference to one or more of the embodiments disclosed herein, for example. One such method involves providing a weight lifting member having weight supports and defining a longitudinal axis; providing weights sized and configured to be supported by the weight supports; providing a weight selector having a first end portion sized and configured for insertion into less than all of the weights, and a relatively longer, second end portion sized and configured for insertion into a relatively greater number of the weights; and alternatively inserting the first end portion and the second end portion into respective weights to secure desired combinations of the weights to the lifting member.

The subject invention may also be described in terms of adjustable exercise weight systems. One such system includes a weight lifting member that defines a longitudinal axis; weight supports mounted on the weight lifting member; weights sized and configured to be supported by the weight supports; and a weight selector having a first end portion configured to select a first combination of the weights upon insertion into a passage defined by at least some of the weight supports, and having a second end portion configured to select a different, second combination of the weights upon insertion into the passage.

The present invention has been described with reference to specific embodiments and particular applications. However, this disclosure will enable those skilled in the art to derive additional embodiments and/or applications. For example, some of the disclosed selection apparatus and/or methods may be applicable to weight stack machines, as well as free weights. Moreover, features of the disclosed embodiments and/or methods may be mixed and matched in numerous ways to arrive at additional variations of the present invention. In view of the foregoing, the scope of the present invention is to be limited only to the extent of the following claims.

What is claimed is:

1. A method of adjusting weight resistance to exercise, comprising the steps of:

providing a weight lifting member having weight supports and defining a longitudinal axis;

providing weights sized and configured to be supported by the weight supports;

providing a weight selector having a first end portion sized and configured for insertion into less than all of the weights, and a relatively longer, second end portion sized and configured for insertion into a relatively greater number of the weights; and alternatively inserting the first end portion and the second end portion into respective weights to secure desired combinations of the weights to the lifting member.

2. The method of claim 1, wherein the weight lifting member is provided with a handle, and a first group of the weight supports is disposed at one end of the handle, and a second group of the weight supports is disposed at an opposite end of the handle.

3. The method of claim 2, further comprising the step of providing a retainer on the weight lifting member to releasably retain either said end portion when the other said end portion is inserted into respective said weights.

4. The method of claim 2, wherein a first one of the weights is provided with an outwardly projecting tab that extends laterally in a first direction and defines a first hole, and a second one of the weights is provided with an outwardly projecting tab that extends laterally in an opposite, second direction and defines a second hole, and when the first one of the weights and the second one of the weights are axially aligned, each said tab is visible from each end of the longitudinal axis.

5. The method of claim 2, wherein a third one of the weights is provided with a first outwardly projecting tab that extends laterally in the first direction and defines a third hole that aligns with the first hole, and with a second outwardly projecting tab that extends laterally in the second direction and defines a fourth hole that aligns with the second hole, and only the second portion is long enough to enter both the third hole and the first hole and alternatively, to enter both the fourth hole and the second hole.

6. The method of claim 2, further comprising the step of providing a base to support the weights in a rest position.

7. An exercise dumbbell, comprising:

a handle assembly that defines a longitudinal axis;

weight supports secured to opposite ends of the handle assembly;

weights sized and configured to be supported by the weight supports, including a first weight having an outwardly projecting tab that extends laterally in a first direction and defines a first hole, and a second weight having an outwardly projecting tab that extends laterally in an opposite, second direction and defines a second hole, wherein when the first weight and the second weight are axially aligned, each said tab is visible from each end of the longitudinal axis; and a weight selector configured for insertion through at least one of the weight supports, through the first hole, and alongside of the second weight, and alternatively, for insertion through at least one of the weight supports, alongside of the first weight, and through the second hole.

8. The exercise dumbbell of claim 7, further comprising a base configured to support the weights in a rest position.

9. The exercise dumbbell of claim 7, wherein the weight selector includes a first end portion and a relatively longer, second end portion that extends perpendicular to the first end portion.

10. The exercise dumbbell of claim 9, wherein the weights include a third weight having a first outwardly projecting tab that extends laterally in the first direction and defines a third hole that aligns with the first hole, and a second outwardly projecting tab that extends laterally in the second direction and defines a fourth hole that aligns with the second hole, and only the second portion is long enough to enter both the third hole and the first hole and alternatively, to enter both the fourth hole and the second hole.

11. The exercise dumbbell of claim 7, wherein at least two of the weight supports are configured to define a first passage that aligns with the first hole, and a second passage that aligns with the second hole, and a third passage that extends above the tab on the first weight and alongside of the second weight.

12. An adjustable weight exercise apparatus, comprising:

a weight lifting member that defines a longitudinal axis;

weight supports mounted on the weight lifting member;

weights sized and configured to be supported by the weight supports; and a weight selector having a first end portion configured to select a first combination of the weights upon insertion into a passage defined by at least some of the weight supports, and having a second end portion configured to select a different, second combination of the weights upon insertion into the passage.

13. The exercise apparatus of claim 12, wherein the weight lifting member includes a handle, and a first group of the weight supports is disposed at one end of the handle, and a second group of the weight supports is disposed at an opposite end of the handle.

14. The exercise apparatus of claim 13, wherein the weight selector is L-shaped.

15. The exercise apparatus of claim 14, wherein the second end portion is longer than the first end portion.

16. The exercise apparatus of claim 13, wherein the passage extends through a first one of the weights and alongside of a second one of the weights.

17. The exercise apparatus of claim 16, wherein the passage extends through an outwardly projecting tab on the first one of the weights.

18. The exercise apparatus of claim 13, wherein the first end portion is configured to select a third combination of the weights upon insertion into a second passage defined by at least some of the weight supports, and the second end portion is configured to select a fourth combination of the weights upon insertion into the second passage.

19. The exercise apparatus of claim 13, wherein a first one of the weights defines a notch that aligns with the passage, and a second one of the weights defines a notch that aligns with the passage.

20. The exercise apparatus of claim 13, wherein the weight selector is a bar, and at least one notch in the bar has an axially measured width that is greater than an axially measured thickness of at least one of the weights.

21. The exercise apparatus of claim 13, further comprising a means for discouraging unintended removal of the weight selector from the passage.

22. The exercise apparatus of claim 21, wherein the means includes a clip that disposed adjacent one of the weight supports and configured to releasably retain either said end portion when the other said end portion is inserted into the passage.

23. An exercise dumbbell, comprising:

a handle that defines a longitudinal axis;

weight supports mounted on opposite ends of the handle;

weights sized and configured to be supported in respective, axially spaced positions defined by the weight supports; and a weight selector having a first end portion configured to span a first group of the weights upon insertion into a passage defined by at least some of the weight supports, and a relatively longer, second end portion configured to span a second group of the weights upon insertion into a passage defined by at least some of the weight supports.

24. The exercise dumbbell of claim 23, further comprising a base configured to support the weights in a rest position.

25. An exercise dumbbell, comprising:

a handle assembly having a handle that defines a longitudinal axis;

first weight supports mounted on a first end of the handle assembly;

second weight supports mounted on a second end of the handle assembly;

first end weights configured to be supported in respective, axially spaced positions defined by the first weight supports, wherein the first end weights include a first weight, a second weight that weighs twice as much as the first weight, and a third weight that weighs three times as much as the first weight;

second end weights configured to be supported in respective, axially spaced positions defined by the second weight supports, wherein the second end weights include a fourth weight, a fifth weight that weighs twice as much as the fourth weight, and a sixth weight that weighs three times as much as the fourth weight; and at least one weight selector configured to releasably connect different combinations of the weights to the handle assembly wherein the at least one weight selector is inserted through a first passage defined by the weight supports to select a first combination of the weights, and the at least one weight selector is alternatively inserted through a second passage defined by the weight supports to select a second combination of the weights.

26. The exercise dumbbell of claim 25, further comprising a base configured to support the weights in a rest position.

27. The exercise dumbbell of claim 25, wherein the first passage aligns with holes in only the first weight and the third weight, and the second passage aligns with holes in only the second weight and the third weight.

* * * * *